US008480458B2

(12) United States Patent
White, Jr.

(10) Patent No.: US 8,480,458 B2
(45) Date of Patent: Jul. 9, 2013

(54) GRINDING WHEEL DRESSING SYSTEM

(75) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 0 days.

(21) Appl. No.: 13/231,396

(22) Filed: Sep. 13, 2011

(65) Prior Publication Data

US 2013/0065492 A1 Mar. 14, 2013

(51) Int. Cl.
*B24B 21/18* (2006.01)

(52) U.S. Cl.
USPC ..... 451/443; 451/444; 451/269; 451/271; 451/291

(58) Field of Classification Search
USPC ..... 451/56, 269, 270, 271, 285, 287, 451/291, 443, 444
See application file for complete search history.

(56) References Cited

U.S. PATENT DOCUMENTS

| | | | | |
|---|---|---|---|---|
| 3,925,936 | A | 12/1975 | Orlov et al. | |
| 5,938,506 | A * | 8/1999 | Fruitman et al. | 451/41 |
| 6,145,849 | A | 11/2000 | Bae et al. | |
| 6,206,765 | B1 * | 3/2001 | Sanders et al. | 451/56 |
| 6,241,590 | B1 | 6/2001 | Heijkenskjold | |
| 6,338,672 | B1 | 1/2002 | White | |
| 6,609,962 | B1 | 8/2003 | Wakabayashi et al. | |
| 6,672,945 | B1 | 1/2004 | Matsuo et al. | |

OTHER PUBLICATIONS

International Search Report dated Jul. 10, 2012 filed in PCT/US2012/035973.

* cited by examiner

*Primary Examiner* — Eileen P. Morgan
(74) *Attorney, Agent, or Firm* — Rankin, Hill & Clark LLP

(57) ABSTRACT

A grinding wheel dressing assembly includes a driving gear rotatable about a central axis and a dressing ring engaged with the driving gear. Rotation of the driving gear about the central axis results in rotation of the dressing ring about an offset axis, which is offset from the central axis. The dressing ring includes a contact surface generally normal to the offset axis and adapted to remove dull CBN particles from a substantially planar grinding surface of a grinding wheel that comes into contact with the contact surface.

15 Claims, 2 Drawing Sheets

GRINDING WHEEL DRESSING SYSTEM

BACKGROUND

Grinding machines are used to flatten surfaces of machine parts. Grinding machines can include one or two grinding wheels. Where two grinding wheels are found in a grinding machine, a parts carrier is positioned between opposing planar grinding surfaces of the grinding wheels. Where one grinding wheel is found in the grinding machine, the parts carrier is typically positioned below the planar grinding surface of the grinding wheel.

It is necessary to periodically dress and/or true the grinding surface that contacts parts loaded into a parts carrier of the grinding machine. Dressing a grinding wheel refers to removal of swarf, dull grains and bonding material from the grinding material on the grinding surface. Dressing sharpens the grinding wheel. Truing refers to dressing of a wheel to return the grinding surface to its original shape, or the removal of material from the grinding surface of the wheel so that the resultant grinding surface runs true to some other surface.

U.S. Pat. No. 6,338,672 discloses a dressing wheel system for dressing planar grinding surfaces in a grinding machine. In this dressing wheel system, a plurality of planetary dressing wheels are driven by the same pinion drive that typically drives the parts carrier of the grinding machine. The grinding wheel system disclosed in U.S. Pat. No. 6,338,672 works well, but does require loading and unloading of multiple dressing wheels, which increases the downtime of the grinding machine while the grinding surfaces are being dressed.

SUMMARY

An example of a grinding wheel dressing assembly that addresses at least one of the concerns mentioned above includes a driving gear rotatable about a central axis and a dressing ring engaged with the driving gear. Rotation of the driving gear about the central axis results in rotation of the dressing ring about an offset axis, which is offset from the central axis. The dressing ring includes a contact surface generally normal to the offset axis and adapted to remove dull CBN particles from a substantially planar grinding surface of a grinding wheel that comes into contact with the contact surface.

An example of a method for dressing a grinding wheel includes rotating a grinding wheel including a substantially planar grinding surface, rotating a dressing ring about an offset axis, which is offset from the central axis, and contacting the grinding surface of the rotating grinding wheel with the rotating dressing ring. The planar grinding wheel surface of the grinding wheel has an outer diameter $od_1$. The dressing ring has an outer diameter $od_2$, which is greater than $od_1/2$.

DETAILED DESCRIPTION

Figure 1:
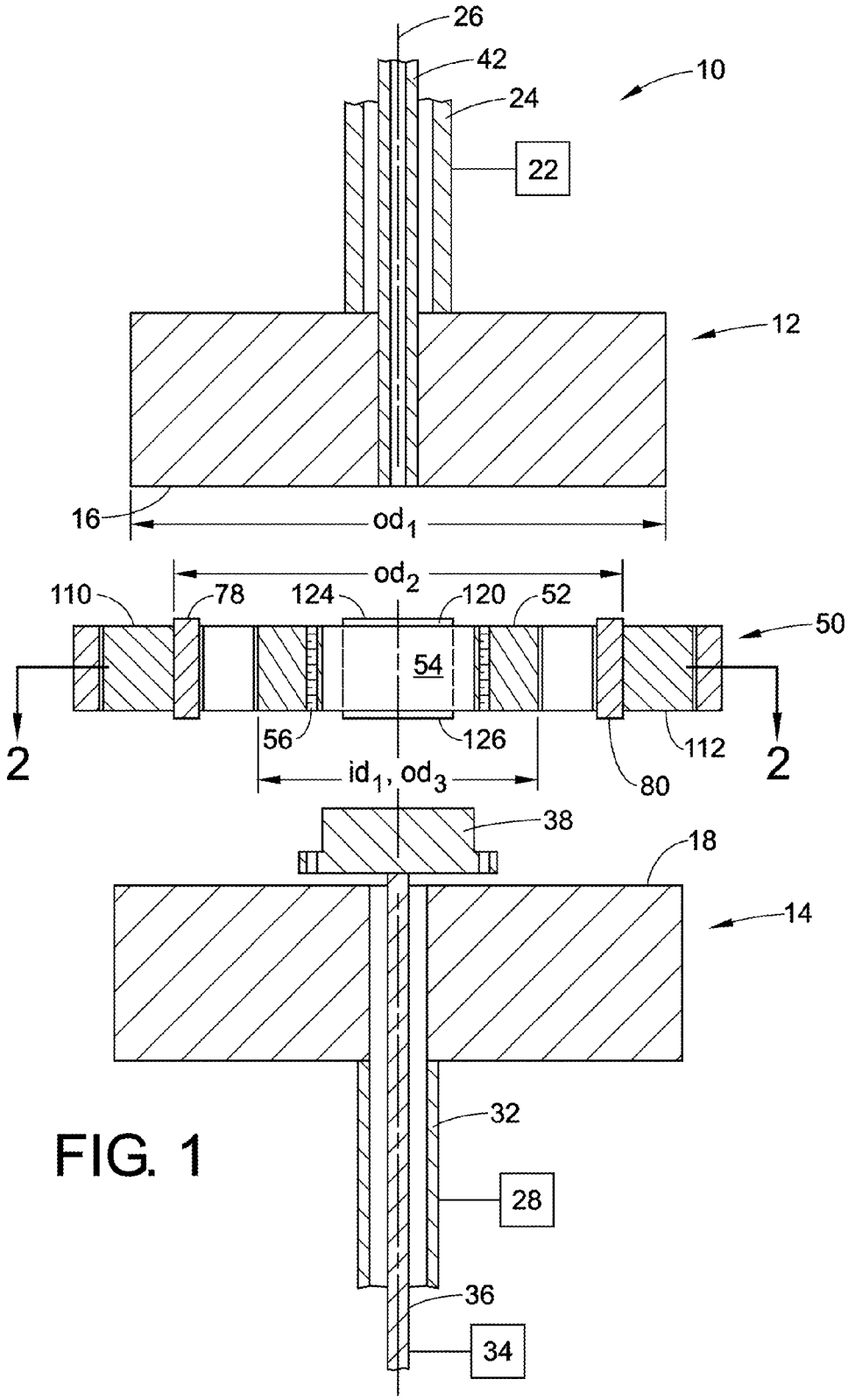
FIG. 1 is a schematic cross-sectional side view of a grinding machine.

The description and drawings herein are merely illustrative and are provided so that one of ordinary skill in the art can make and use a grinding wheel dressing assembly described herein. Various modifications and alterations can be made in the structures and steps disclosed without departing from the scope of the invention, which is defined by the appended claims. Various identified components of a grinding machine disclosed herein are merely terms of art that may vary from one manufacturer to another. The terms should not be deemed to limit the invention. The drawings are shown for purposes of illustrating one or more exemplary embodiments and are not for purposes of limiting the appended claims. All references to direction and position, unless otherwise indicated, refer to the orientation of the components illustrated in the drawings and are not to be construed as limiting the appended claims.

FIG. 1 schematically depicts a grinding machine 10 that includes an upper grinding wheel 12 and a lower grinding wheel 14. The upper grinding wheel 12 includes an upper planar grinding surface 16. The lower grinding wheel 14 includes a lower planar grinding surface 18. The grinding surfaces 16, 18 are used to flatten machine parts that are loaded into the grinding machine 10 between the grinding surfaces. The grinding surfaces 16, 18 periodically require dressing and or truing. For the purposes of this disclosure, dressing the grinding surface encompasses truing the grinding surface.

In the illustrated embodiment, each planar grinding wheel surface 16, 18 has an outer diameter $od_1$. Each planar grinding wheel surface 16, 18 includes grinding particles, such as cubic-boron-nitride (CBN) particles embedded in each respective grinding wheel 12, 14. The CBN particles are suspended in a plastic carrier located at the planar grinding wheel surface 16, 18 of each respective wheel 12, 14. Other grinding particles and other carriers may be employed.

A first motor 22 operatively connects with a first drive shaft 24 to rotate the upper grinding wheel 12 about a central rotational axis 26. A second motor 28 operatively connects with a second drive shaft 32 to rotate the lower grinding wheel 14 about the central rotational axis 26. A third motor 34 can operatively connect with a drive gear shaft 36 to rotate a drive pinion 38 about the central rotational axis 26. The drive pinion 38 can typically drive a parts carrier (not shown) of the grinding machine. During a grinding operation coolant fluid can be fed into the grinding machine 10 through a fluid conduit 42.

A grinding wheel dressing assembly 50 can be used to dress and/or true the grinding surfaces 16, 18 of the respective grinding wheels 12, 14. Although the grinding wheel dressing assembly 50 is described as a "dressing assembly," it is understood that the grinding wheel dressing assembly can also be used to true the grinding surface 16, 18.

Figure 2:
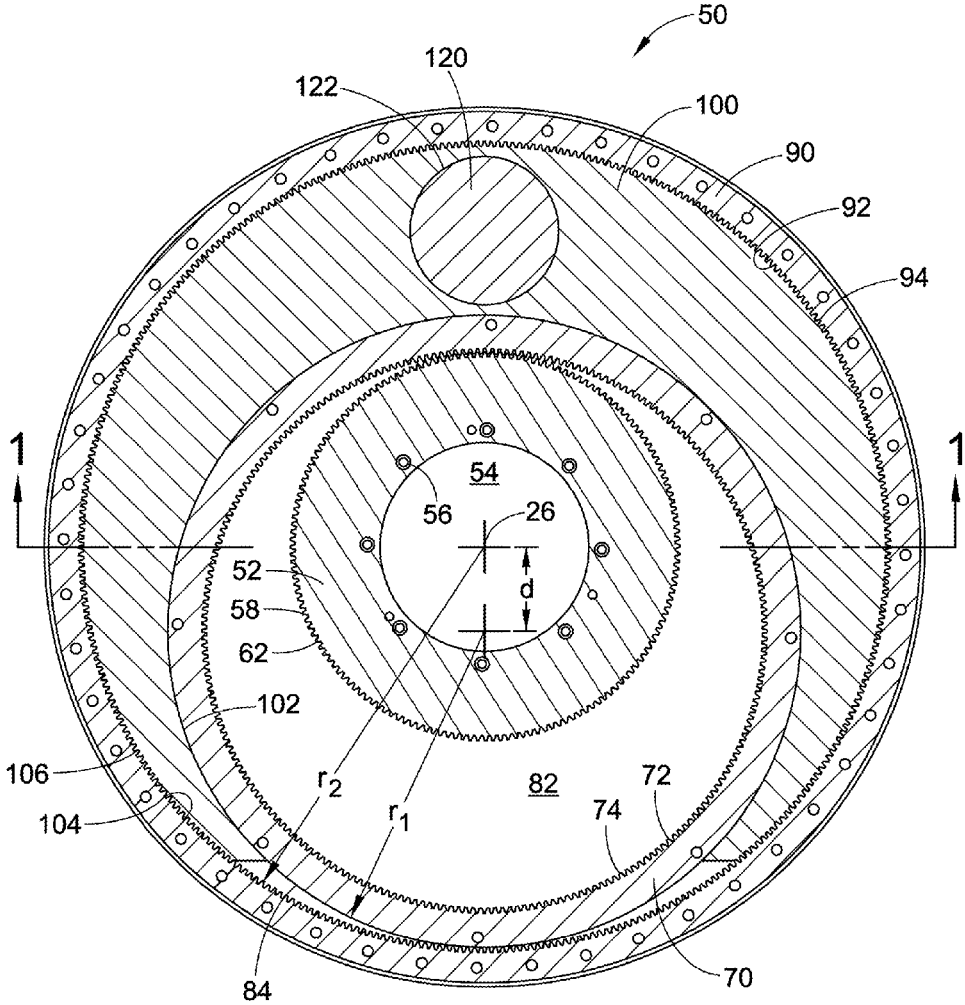
FIG. 2 is a cross-sectional view of a grinding wheel dressing assembly used to dress and/or true grinding wheels of the grinding machine shown in FIG. 1.

The grinding wheel dressing assembly 50 includes a driving gear 52, which is configured to be driven by the drive pinion 38. The driving gear 52 includes a central opening 54 and a plurality of bolt holes 56 to facilitate attachment of the driving gear 52 to the drive pinion 38. The driving gear 52 is a circular gear that rotates about the central axis 26. With reference to FIG. 2, the driving gear 52 includes an outer circumferential surface 58, which in the illustrated embodiment includes a plurality of gear teeth, referred to herein as driving gear teeth 62.

The grinding wheel dressing assembly 50 further includes a dressing ring 70 engaged with the driving gear 52. The dressing ring 70 includes an inner circumferential surface 72 that includes a plurality of teeth, referred to herein as dressing ring teeth 74. The dressing ring teeth 74 on the inner circumferential surface 72 of the dressing ring 70 engage the driving gear teeth 62 on the outer circumferential surface 58 of the driving ring 52. In the embodiment depicted in FIG. 2, the dressing ring teeth 72 engage the driving gear teeth 62 near a 12 o'clock position on the dressing ring 70 and the driving gear 52 (per the orientation shown in FIG. 2). Rotation of the driving gear 52 about the central axis 26 results in rotation of the dressing ring 70 about an offset axis 76, which is offset from the central axis 26. As seen in FIG. 1, the central axis 26 is offset from the offset axis 76 a distance d.

With reference back to FIG. 1, the dressing ring 70 includes an upper contact surface 78 disposed generally normal to the offset axis 76. The upper contact surface 78 is adapted to remove dull CBN particles from the upper planar grinding surface 16 of the upper grinding wheel 12 when the grinding surface 16 comes into contact with the contact surface 78. The dressing ring 70 also includes a lower contact surface 80 (shown in FIG. 1) that is disposed generally normal to the offset axis 76. The lower contact surface 80 is adapted to remove dull CBN particles from the lower planar grinding surface 18 of the lower grinding wheel 14 that comes into contact with the contact surface. A dressing ring height is defined between the upper contact surface 78 and the lower contact surface 80 measured parallel to the central axis 26.

As illustrated in FIG. 2, the dressing ring 70 surrounds the driving gear 52. The dressing ring 70, which is annular, and the driving gear 52, which is a circular gear, define a crescent-shaped void 82 between the inner circumferential surface 72 of the dressing ring 70 and the outer circumferential surface 58 of the driving gear 52. The dressing ring 70 further includes an outer circumferential bearing surface 84. The outer circumferential bearing surface 84 of the dressing ring 70 is offset from the offset axis 76 a radius $r_1$.

The grinding wheel dressing assembly 50 further includes an outer ring 90 having an interior circumferential surface 92. A plurality of outer ring teeth 94 on the interior circumferential surface 92 extend inwardly toward the central axis 26. The interior circumferential surface 92 of the outer ring 90 is offset from the central axis a radius $r_2$. The radius $r_2$ of the interior circumferential surface 92 of the outer ring 90 is substantially equal to $r_1$ (the radius to the outer circumferential bearing surface 84 of the dressing ring 70)+distance d, which is the distance that the central axis 26 is offset from the offset axis 76.

The grinding wheel dressing assembly 50 further includes a bearing insert 100. The bearing insert 100 can be made from an ultra high weight polyethylene material. The bearing insert 100 includes an inner substantially circular bearing surface 102 and an outer substantially circular surface 104. The inner substantially circular bearing surface 102 of the bearing insert 100 bears against the outer circumferential bearing surface 84 of the dressing ring 70. The inner bearing surface 102 of the bearing insert 100 follows the radius $r_1$ and the outer substantially circular surface 104 follows the radius $r_2$. Since the central axis 26 is offset from the offset axis 76, the inner bearing surface 102 does not make up a complete circle. As shown in FIG. 2, the bearing insert 100 is positioned between the dressing ring 70 and the outer ring 90. The inner diameter of the outer ring $2r_2$, is substantially equal to the outer diameter $od_1$ of the planar grinding surfaces 16, 18 of the respective grinding wheels 12, 14.

The outer substantially circular surface 104 of the bearing insert 100 includes a plurality of bearing insert teeth 106. The outer substantially circular surface 104 of the bearing insert 100 engages with the outer ring 90 to fix the bearing insert 100 with respect to the outer ring 90. In doing so, the bearing insert teeth 106 engage with the outer ring teeth 94. The bearing insert 104 is substantially crescent-shaped when viewed normal to the central axis 26. With reference to FIG. 1, the bearing insert 100 includes an upper surface 110 and a lower surface 112. As seen in FIG. 1, the upper surface 78 of the dressing ring 70 extends above the upper surface 110 of the bearing insert 100, and the lower surface 80 of the dressing ring 70 extends below the lower surface 112 of the bearing insert in a direction parallel to the central axis 26. Accordingly, when the contact surfaces 78, 80 of the dressing ring 70 are in contact with the grinding surfaces 16, 18, respectively, the upper surface 110 and the lower surface 112 of the bearing insert 100 do not contact, i.e., are offset from, the grinding surfaces.

The grinding wheel dressing assembly 50 further includes a grinding wheel support 120. The grinding wheel support 120 is depicted as a circular disk in FIG. 2; however, the grinding wheel support can take an alternative configuration. The grinding wheel support 120 keeps the respective grinding wheels 12, 14 in balance during the dressing operation. With reference to FIG. 1, the grinding wheel support 120 has a first (upper) planar surface 124 and a second (lower) planar surface 126 opposite the first surface. A grinding wheel support height is defined between the first surface 124 and the second surface 126 parallel to the central axis 26. As noticeable in FIG. 1, the dressing ring height is substantially equal to the grinding wheel support height. Due to the similarity in height, the respective grinding wheels 12, 14 in the area outside of the dressing ring 70 remain supported and in balance because the first surface 124 of the grinding wheel support 120 contacts the upper grinding surface 16 of the upper wheel 12 and the lower grinding surface 18 of the lower wheel 14 during the dressing operation. The grinding wheel support 120 can be made from a material, e.g., steel, that wears at the same or very similar rate as the dressing ring 70.

The grinding wheel support 120 is interposed between the dressing ring 70 and the outer ring 90. The bearing insert 100 includes a grinding wheel support opening 122, and the grinding wheel support 120 is received in the opening. As such, the grinding wheel support 120 is at least partially surrounded (as depicted the grinding wheel support 120 is entirely surrounded) by the bearing insert 100. The grinding wheel support opening 122 is substantially the same size (diameter) and shape of the grinding wheel support 120. The grinding wheel support opening 122 is provided in an area of the bearing insert 100 having a greatest dimension measured radially from the central axis 26 between the inner substantially circular bearing surface 102 and the outer substantially circular surface 104.

When truing or dressing one or both of the grinding surfaces 16, 18 of the respective grinding wheels 12, 14, the grinding wheels 12, 14 are rotated about the central axis 26. With the grinding wheels 12, 14 rotating about the central axis 26, the dressing ring 70 rotates about the offset axis 76, which is offset from the central axis. With the dressing ring 70 rotating, the rotating grinding wheels 16, 18 are in contact with the rotating dressing ring 70. The grinding wheels 16, 18 also remain balanced because of the grinding wheel support 120 discussed above. As mentioned above, each grinding wheel surface 16, 18 has an outer diameter $od_1$. The dressing ring has an outer diameter $od_2$ which is greater than $od_1/2$.

The outer diameter of the grinding surfaces 16, 18 of the respective grinding wheels 12, 14 is substantially equal to the diameter of the interior circumferential surface 104 of the outer ring 90 ($od_1=2r_2$). An outermost edge of the dressing ring 70 (shown as the 6 o'clock position in FIG. 2) nearly comes into contact with the interior circumferential surface 104 of the outer ring 90. As such, the dressing ring 70 is capable of contact with the entirety of each grinding surface 16, 18 of the respective grinding wheels 12, 14 as the grinding wheels are rotated about the central axis 26. The upper and lower substantially planar surfaces 78, 82 of the dressing ring 70 remove dull CBN particles from the respective grinding surfaces 16, 18 to dress the grinding surfaces 16, 18 and can return the grinding surfaces to a substantially planar configuration to true the grinding surfaces.

Each substantially planar grinding wheel surface 16, 18 also has an inner diameter $id_1$. The drive gear 52 has an outer diameter $od_3$ that is substantially equal to the inner diameter $id_1$. The difference in the diameter of the drive ring 52 and the diameter of the dressing ring 70, along with the axes 26, 76 being offset, results in the crescent-shaped gap 82 between the inner circumferential surface 72 of the dressing ring 70 and the outer circumferential surface 58 of the driving gear 52. The removed CBN particles can fall into this crescent-shaped gap and then be removed via the conduit 42 providing cleaning fluid into the grinding machine 10.

A grinding wheel dressing assembly, which can be used for dressing and truing the grinding wheel, is shown above that is easier to load and operate than known grinding wheel dressing assemblies. Modifications and alterations will occur to those upon reading and understanding the preceding detailed description. The invention is not limited only to the embodiment described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A grinding wheel dressing assembly comprising:

a driving gear rotatable about a central axis, the driving gear including driving gear teeth on an outer circumferential surface;

a dressing ring surrounding the driving gear, the dressing ring including dressing ring teeth on an inner circumferential surface and engaging the driving gear teeth, wherein rotation of the driving gear about the central axis results in rotation of the dressing ring about an offset axis, which is offset from the central axis, wherein the dressing ring includes a contact surface adapted to remove dull CBN particles from a substantially planar grinding surface of a grinding wheel that comes into contact with the contact surface;

an outer ring having an interior circumferential surface; and a bearing insert having an inner substantially circular bearing surface and an outer substantially circular surface, the inner substantially circular bearing surface bearing against an outer circumferential bearing surface of the dressing ring and the outer substantially circular surface of the bearing insert engages with the outer ring to fix the bearing insert with respect to the outer ring.

2. The assembly of claim 1, wherein the dressing ring includes an upper substantially planar surface and a lower substantially planar surface, wherein the contact surface is at least one of the upper substantially planar surface and the lower substantially planar surface.

3. A grinding wheel dressing assembly comprising:

a driving gear rotatable about a central axis;

a dressing ring surrounding and engaged with the driving gear, wherein rotation of the driving gear about the central axis results in rotation of the dressing ring about an offset axis, which is offset from the central axis, wherein the dressing ring includes a contact surface adapted to remove dull CBN particles from a substantially planar grinding surface of a grinding wheel that comes into contact with the contact surface;

an outer ring having an interior circumferential surface; and a bearing insert having an inner substantially circular bearing surface and an outer substantially circular surface, the inner substantially circular bearing surface bearing against an outer circumferential bearing surface of the dressing ring and the outer substantially circular surface of the bearing insert engages with the outer ring to fix the bearing insert with respect to the outer ring.

4. The assembly of claim 3, wherein the dressing ring includes an inner circumferential surface and the driving gear includes an outer circumferential surface, wherein the inner circumferential surface engages the outer circumferential surface.

5. The assembly of claim 3, wherein the bearing insert is substantially crescent shaped when viewed normal to the central axis.

6. The assembly of claim 3, wherein the outer substantially circular surface of the bearing insert includes external teeth and the interior circumferential surface of the outer ring includes internal teeth that engage the external teeth to fix the bearing insert with respect to the outer ring.

7. The assembly of claim of claim 3, wherein the central axis is offset from the offset axis a distance d, wherein the outer circumferential bearing surface of the dressing ring is offset from the offset axis a radius $r_1$, wherein the interior circumferential surface of the outer ring is offset from the central axis a radius $r_2$, wherein $r_1+d$ is substantially equal to $r_2$.

8. The assembly of claim of claim 3, wherein the bearing insert includes an upper surface and a lower surface, wherein the contact surface extends above the upper surface or below the lower surface in a direction parallel to the central axis.

9. The assembly of claim 3, further comprising a grinding wheel support interposed between the dressing ring and the outer ring, wherein the grinding wheel support is at least partially surrounded by the bearing insert.

10. The assembly of claim 9, wherein the dressing ring includes an upper surface and a lower surface, wherein a dressing ring height is defined between the upper surface and the lower surface parallel to the central axis, wherein the grinding wheel support has a first surface and a second surface opposite the first surface, wherein a grinding wheel support height is defined between the first surface and the second surface parallel to the central axis, wherein the dressing ring height is substantially equal to the grinding wheel support height.

11. The assembly of claim 3, further comprising a grinding wheel support, wherein the bearing insert includes a grinding wheel support opening receiving the grinding wheel support, wherein the grinding wheel support opening is provided in an area of the bearing insert having a greatest dimension measured radially from the central axis between the inner substantially circular bearing surface and the outer substantially circular surface.

12. The assembly of claim 3, wherein the dressing ring and the driving gear define a crescent-shaped void between an inner circumferential surface of the dressing ring and an outer circumferential surface of the driving gear.

13. A grinding wheel dressing assembly comprising:

a driving gear rotatable about a central axis; and a dressing ring engaged with the driving gear, wherein rotation of the driving gear about the central axis results in rotation of the dressing ring about an offset axis, which is offset from the central axis, wherein the dressing ring includes a contact surface adapted to remove dull CBN particles from a substantially planar grinding surface of a grinding wheel that comes into contact with the contact surface, wherein the dressing ring and the driving gear define a crescent-shaped void between an inner circumferential surface of the dressing ring and an outer circumferential surface of the driving gear.

14. The assembly of claim 13, further comprising:

an outer ring having an interior circumferential surface; and a bearing insert having an inner substantially circular bearing surface and an outer substantially circular surface, the inner substantially circular bearing surface bearing against an outer circumferential bearing surface of the dressing ring and the outer substantially circular surface of the bearing insert engages with the outer ring to fix the bearing insert with respect to the outer ring.

15. A grinding wheel dressing assembly comprising:

a driving gear rotatable about a central axis, the driving gear including driving gear teeth on an outer circumferential surface; and a dressing ring surrounding the driving gear, the dressing ring including dressing ring teeth on an inner circumferential surface and engaging the driving gear teeth, wherein rotation of the driving gear about the central axis results in rotation of the dressing ring about an offset axis, which is offset from the central axis, wherein the dressing ring includes a contact surface adapted to remove dull CBN particles from a substantially planar grinding surface of a grinding wheel that comes into contact with the contact surface, wherein the dressing ring and the driving gear define a crescent-shaped void between an inner circumferential surface of the dressing ring and an outer circumferential surface of the driving gear.

* * * * *